US010745231B2

(12) United States Patent
Deocon Mir et al.

(10) Patent No.: US 10,745,231 B2
(45) Date of Patent: Aug. 18, 2020

(54) MEDIA STACKERS

(71) Applicant: Hewlett-Packard Development Company, L.P., Spring, TX (US)

(72) Inventors: Javier Deocon Mir, Sant Cugat del Valles (ES); Eduardo Martin Orue, Sabadell (ES); Josep Ortiz Mompel, Terrassa (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,960

(22) PCT Filed: Nov. 30, 2015

(86) PCT No.: PCT/EP2015/078075
§ 371 (c)(1),
(2) Date: Mar. 16, 2018

(87) PCT Pub. No.: WO2017/092786
PCT Pub. Date: Jun. 8, 2017

(65) Prior Publication Data
US 2018/0265322 A1 Sep. 20, 2018

(51) Int. Cl.
*B65H 29/68* (2006.01)
*B65H 31/02* (2006.01)
(Continued)

(52) U.S. Cl.
CPC ..... *B65H 29/68* (2013.01); *B65H 29/14* (2013.01); *B65H 31/02* (2013.01); *B65H 31/26* (2013.01);
(Continued)

(58) Field of Classification Search
CPC ..... B65H 31/26; B65H 29/68; B65H 2701/1313; B65H 2701/11312
See application file for complete search history.

(56) References Cited

U.S. PATENT DOCUMENTS 5,295,678 A * 3/1994 Lindner ..... B65H 1/18 271/152
6,585,341 B1 7/2003 Walker et al.
(Continued)

FOREIGN PATENT DOCUMENTS

CN 1683228 10/2005
CN 1865107 11/2006
(Continued)

OTHER PUBLICATIONS

High-speed Paper Feeding System Technology, RISO Creative Manufacturing, Available online: < https://www.riso.co.jp/english/tech_portal/core/speed.html >.

*Primary Examiner* — Patrick Cicchino
(74) *Attorney, Agent, or Firm* — HP Inc. Patent Department

(57) ABSTRACT

A media stacker (100) comprises a stacking platform (102), a feed mechanism (104), a media arresting mechanism (106) and a controller (108). The feed mechanism conveys media sheets for dispensing onto the stacking platform, wherein the media sheets are dispensed onto the stacking platform with a momentum imparted by the feed mechanism. The media arresting mechanism reduces the momentum of media sheets. The controller determines that a trailing edge of a media sheet is to be dispensed onto the stacking platform, and further control the media arresting apparatus to reduce the momentum of the media sheet in response to the determination.

19 Claims, 5 Drawing Sheets

(51) Int. Cl.
*B65H 31/26* (2006.01)
*B65H 29/14* (2006.01)

(52) U.S. Cl.
CPC ..... *B65H 2301/4212* (2013.01); *B65H 2513/108* (2013.01); *B65H 2513/11* (2013.01); *B65H 2513/22* (2013.01); *B65H 2513/222* (2013.01); *B65H 2701/11312* (2013.01); *B65H 2701/1313* (2013.01); *B65H 2801/03* (2013.01)

(56) References Cited

U.S. PATENT DOCUMENTS 6,999,211 B2 * 2/2006 Sekiya ..... B65H 7/14 358/404
7,520,505 B2 4/2009 Thomas et al.
7,532,854 B2 * 5/2009 Shin ..... B65H 29/14 399/405
8,408,540 B2 * 4/2013 Uchiyama ..... B65H 31/26 271/207
8,714,547 B2 * 5/2014 Uchiyama ..... B65H 29/14 270/58.11
8,870,175 B2 * 10/2014 Gamo ..... B65H 39/00 270/58.09
10,150,637 B2 * 12/2018 Wakayama ..... B65H 31/22
2003/0193132 A1 10/2003 Robertson et al.
2013/0187328 A1 * 7/2013 Yamazaki ..... B65H 29/00 271/189
2015/0239702 A1 * 8/2015 Sugiyama ..... B65H 33/08 271/220
2015/0246560 A1 9/2015 Nakamura et al.

FOREIGN PATENT DOCUMENTS

CN 101962131 2/2011
CN 102530627 7/2012
CN 102887391 1/2013

* cited by examiner

MEDIA STACKERS

BACKGROUND

Media stackers may be used to stack media (for example, media sheets output by a printer associated therewith). In some examples, media may comprise sheets of material, such as paper, cardboard, plastics or the like, which may be relatively flexible. Such stackers may comprise feed mechanisms, which convey sheets of media to a stacking platform, for example for retrieval by a user.

BRIEF DESCRIPTION OF DRAWINGS

Examples will now be described, by way of non-limiting example, with reference to the accompanying drawings, in which.

DETAILED DESCRIPTION

Figure 1:
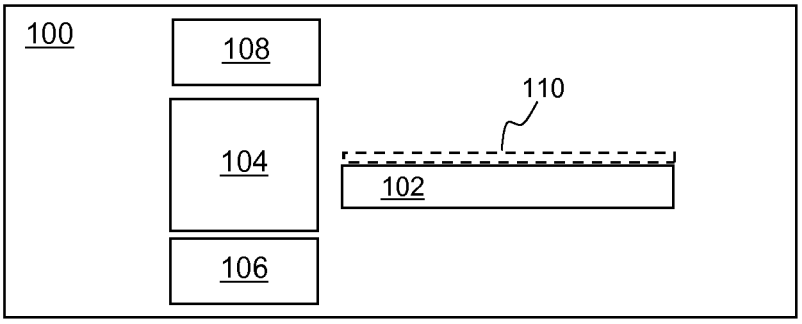
FIGS. 1 to 4 are simplified schematics of examples of media stackers.

FIG. 1 is an example of a media stacker 100 comprising a stacking platform 102, a feed mechanism 104, a media arresting mechanism 106 and a controller 108.

The feed mechanism 104 is arranged to convey media sheets 110 for dispensing onto the stacking platform 102, wherein the media sheets 110 are dispensed onto the stacking platform 102 with a momentum imparted by the feed mechanism 104 (an example sheet is shown in dotted lines as it does not comprise part of the stacker 100) for dispensing onto the stacking platform 102. The media arresting mechanism 106 is to reduce the momentum of media sheets 110. The stacking platform 102 may comprise a tray or the like. The controller 108 is to determine that a trailing edge of a media sheet is to be dispensed onto the stacking platform 102, and further to control the media arresting mechanism 106 to reduce the momentum of the media sheet 110 (for example, slow the speed, or bring the media sheet 110 to a stop) in response to the determination.

Where sheets 110 are dispensed with a momentum, there is a risk that they will be propelled under this momentum along the platform 102. If sheets 110 are propelled along the platform 102, this may cause them to fall from the platform 102 or their trailing edge may present an obstacle to a subsequently stacked sheet 110. In the example of FIG. 1, a media arresting mechanism 106 is used to reduce this momentum. In some examples, the stacker 100 may be intended to stack sheets 110 which are longer than the platform provided to receive the sheets 110. In some examples, the stacker 100 may be intended to handle media at relatively high speeds (for example, on the order of 15 inches per second (ips)); In some examples, the stacker 100 may be intended to be associated with a printer which operates in a continuous print mode. In some examples, the stacker 100 may be intended to be associated with a printer which prints 'long plots', i.e. sheets which are relatively long (around 1-2 m or longer).

The determination that a trailing edge of the media sheet 110 is to be dispensed may be explicit or implicit—for example, implicit determination may comprise counting revolutions, e.g. a predetermined number of whole or partial revolutions of roller(s) in a feed mechanism 104, wherein the number of revolutions is indicative of a length of a sheet conveyed thereby, and explicit detection may comprise detecting a location of the trailing edge.

For example, a determination that a trailing edge of a media sheet 110 is to be dispensed onto the stacking platform 102 may be made using at least one of: a trailing edge detector (for example, an optical sensor which can sense when the end of a sheet passes the sensor); a timer, which may determine the length of a sheet which has been conveyed by a feed mechanism 104 based on a speed of conveyance; and/or a feed mechanism monitor (which may directly measure the length of a sheet 110 conveyed thereby, for example based on the number of revolutions of a roller of a feed mechanism or the like). Use of a trailing edge detector to detect the end of a sheet 110 directly may mean that the length of the sheet 110 need not be predetermined. In some examples, such a detector may be located a predetermined distance from a feed mechanism 104, and a timer may be used to determine when the trailing edge is to be expected to be dispensed.

Figure 2:
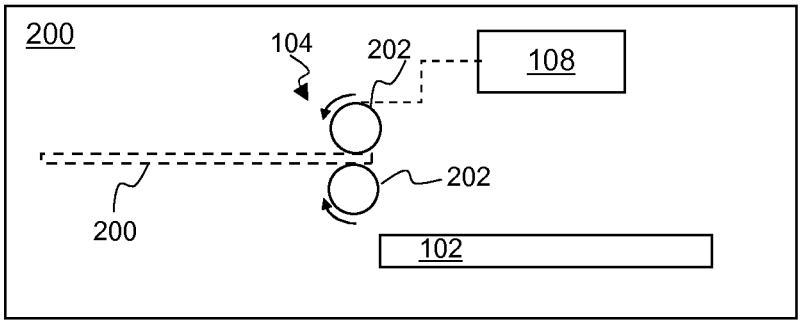

FIG. 2 shows another example of a media stacker 200. In this example, the media arresting mechanism 106 comprises a conveying element 202 of the feed mechanism 104. In this example, the conveying element 202 of the feed mechanism 104 comprises a pair of rollers but in other examples, other feed mechanisms such as an endless belt or the like may be used.

The speed with which a media sheet 110 is conveyed in this example is adjustable under the control of the controller 108. The controller 108 is arranged to reduce the speed with which a media sheet is conveyed by the feed mechanism 104 in response to a determination that a trailing edge of the media sheet 110 is to be dispensed onto the stacking platform 102. In other words, detection of the trailing edge may trigger, either immediately or with a delay, a deceleration of the feed mechanism 104. This arrests the media in the sense that it checks or reduces the speed thereof, while not bringing the media sheet 110 to a complete halt.

For media stackers which may, for example, be intended to stack media at the rate of high speed printers, decelerating the feed mechanism 104 may reduce a risk that sheets 110 will be propelled under their own momentum along the platform 102 (and/or allow slower activation of a securing element, as discussed in relation to other examples below).

In some examples, a media sheet 110 may have a length (for example, defined in the axis of the direction of movement imparted by the feed mechanism 104). The controller 108 may be arranged to control the feed mechanism 104 to convey a media sheet 110 at a first speed until a portion of the length of media sheet 110 is conveyed thereby, and at a second, lower, speed for the remaining portion of the length of media sheet 110.

This means that a portion of the media sheet 110 is conveyed relatively rapidly, allowing for the brisk handling of media sheets 110 within the stacker 100. However, the momentum of the media sheet 110 is reduced by slowing the speed with which the trailing portion of the sheet 110 is conveyed. Therefore, when the sheet 110 is dispensed onto the platform 102, the sheet 110 will have a lower speed and therefore the kinetic energy of the sheet may be more readily overcome with other forces, for example friction between the sheet 110 and the stacking platform 102, or, if the platform 102 already comprises at least one sheet 110 stacked thereon, between the two sheets 110. Under such conditions, the sheet 110 may come to rest without significant travel along the platform 102.

In some examples, the portion of the media sheet 110 conveyed at the first speed is a significant portion thereof and the portion of the media sheet conveyed at the second speed is a relatively small or short portion therefore. For example, for media sheets having a length in the order of 12-78 inches or longer (around 30 cm-2 m), in some examples, the trailing 1 inch or so (or around 2-3 cm) of media sheet length may be conveyed at the lower second speed. In some examples, the portion of the media sheet 110 conveyed at the first speed may comprise at least on the order of 85%, 90%, 95%, 98% or 99% of the length of the sheet. This may be sufficient to slow the speed of the sheet 110 as a whole without significantly slowing the handling of the sheet 110. In examples, the length of the sheet 110 conveyed at the lower speed may be determined as a minimum length which can be controlled securely by the feed mechanism 104. Determination of the length conveyed at the slower speed may comprise an error margin. In some examples, the length may comprise a deceleration portion, allowing time for the speed of the feed mechanism 104 to decrease to a final lower speed.

In some examples, the first speed may, for example, comprise the printing speed of a printer associated with the stacker 200. In some examples, the first speed may comprise values on the order of 15 ips (inches per second), 6 ips, 4 ips or the like (or equivalently in metric values, 0.382 m/s (meters per second), 0.152 m/s and 0.102 m/s). The second speed may for example comprise values on the order of 2 ips (0.051 m/s). In some examples, the media stacker 200 may be intended for association with a printer which conveys media in a continuous manner, i.e. the printer operates with a continuous print mode. By way of contrast, in some examples of printers, the sheet is advanced in stages, for example with printing being carried out on a strip of the media while the media sheet is stationary, and the media being advanced between print passes. A printer operating in continuous print mode may continue to advance media during print passes.

In some examples, the second speed may be a minimum speed of the feed mechanism 104, in order to minimise the momentum of the sheet 110. In some examples, the length of the portion of sheet 110 conveyed at the second speed may as short as is practically and reliably achievable by a particular stacker in order to minimise a reduction in the speed of processing the media sheets 110. In some examples, the second speed may be as high as possible before a sheet 110 is at an appreciable risk of moving down a stacking platform 102, in order to reduce the reduction in the speed of processing the media sheets 110.

In some examples, at least one of the first speed, second speed and/or the length of a sheet 110 conveyed at one of the first and second speeds is at least one of: user configurable, predetermined, or determined based on a factor such as the type of media used, the length of a platform and/or the length of a media sheet 110.

Figure 3:
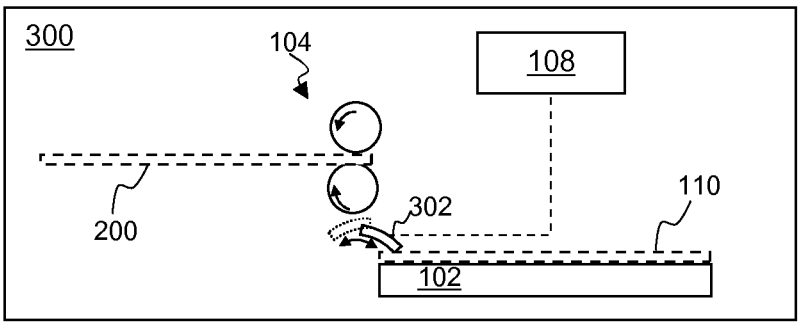

FIG. 3 is an example of a media stacker 300 in which the media arresting mechanism 106 comprises a securing element 302. Dispensed sheets 110 are arranged parallel to a surface of the stacking platform 102, and the feed mechanism 104 imparts a media sheet 110 conveyed thereby with a lateral component of momentum in a direction parallel to the surface of the stacking platform. In this example, the lateral component of momentum acts to provide a force which urges the sheets 110 along the platform 102. In this example, the feed mechanism 104 comprises a pair of rollers but in other examples, other feed mechanisms such as an endless belt or the like may be used. The securing element 302 may fully arrest a sheet 110, i.e. stop its movement entirely, for example by applying a pressure thereto.

The securing element 302 has a securing position, as shown in solid line, in which it acts to secure at least one sheet of media 110 on the stacking platform 102 and a retracted position (shown in dotted line). In some examples, the securing element 302 acts to provide a clamping force on sheet(s) 110 on the platform 102 when in the securing position, and such a clamping force is removed when the securing element 302 is in the retracted position. The controller 108 controls the position of the securing element 302 such that, responsive to a determination that a sheet of media has been, or is imminently to be, dispensed, the controller 108 controls the securing element 302 to move from the securing position to the retracted position, and subsequently from the retracted position to the securing position, thereby securing the dispensed sheet of media 110. Dispensing of a media sheet 110 may comprise dispensing or releasing of the trailing edge of a media sheet 110. The controller 108 may control the position of the securing element 302 responsive to a determination that a media sheet 110 is being dispensed so as to arrest the media sheet having the lateral component of momentum. In other words, in this example, the securing element 302 acts to secure the media sheet against a tendency to move along the platform 102, which is due at least in part to the momentum imparted thereto by the feed mechanism 104.

In some examples, detection of the trailing edge may trigger, either immediately or with a delay, activation of the securing element 302. Detection of the trailing edge may also trigger, either immediately or with a delay, a deceleration of the feed mechanism 104 as discussed in relation to FIG. 2.

In some examples, the securing element 302 presses down on a stack of sheets 110 to secure them, for example under the action of a biasing element (for example, a spring), a servo or a stepper motor or the like. Use of a biasing element such as a spring to provide a clamping force may allow the securing portion to automatically adapt to a height of a stack being secured. In an example, based on the time at which the trailing edge of a sheet 110 is detected (for example, determined as an offset from the trailing edge being detected by a trailing edge detector, wherein the offset is determined to coincide with the trailing edge of a sheet 110 moving through or exiting a feed mechanism 104), the securing element 302 is moved, under the control of the controller 108, into a retracted position shown in dotted lines. This allows the trailing edge of a sheet to fall onto the top the stack in an aligned manner with the stack therebelow. In addition, it means that the trailing edge will be in a position to be secured by the securing element 302 as it moves back into the securing position. In some examples the controller 108 is to control the securing element 302 to (fully) arrest the media sheet after spending a predetermined time period in the retracted position. This time may be relatively brief, for example being determined as the time for the trailing edge of the sheet to settle below a level at which it will be acted on by the securing element 302 (which may or may not mean that the sheet is fully settled on the stack/platform 102). In some examples, the time spent in the retracted position may be less than 1 second, or less than 0.5 seconds, or less than 0.1 seconds. In one example, time spent in the retracted position is on the order of 0.05 seconds.

In some examples, the securing element 302 remains pressed against the sheet 110 for at least around 0.3 seconds. This may ensure that the sheet's motion is fully arrested. In some examples, for the final sheet 110 in a stack, the securing element 302 may assume the securing position to arrest the sheet 110 and remain in the securing position for a predetermined time period, for example around 1 second, before retracting to allow a user to extract the stack. This may also mean that the securing element 302 does not scratch the surface of the sheet when the stack is removed. Such timings may be user configurable, predetermined, or determined based on a factor such as the type of media used, speed of operation, the length of a platform and/or reach of the securing element 302 and/or the length of a media sheet.

In some examples the media may enter a stacker 100, 200, 300 as a sheet 110. In other examples, the stacker 100, 200, 300 may comprise or be associated with a cutter such that the sheets 110 are formed while the media is within the stacker 100.

It will be noted that the platform 102 in FIGS. 1 to 3 (and in FIG. 4 below) is shown as horizontal. In some stackers, it has been proposed to use platforms which slope up at an angle, such that the sheets received thereby are driven 'uphill' by the action of a feed mechanism. Although this reduces a risk that sheet media will fall from the platform, it can cause sheets to roll up, and/or increases the power for a motor driving the feed mechanism. Another risk associated with ramped platform, in particular for relatively thin media or low grammage media or any media having low rigidity, is that the media may be caused to buckle and collapse because, in addition to friction, there is a component of the media weight that acts against the advance of the media. However slowing sheets 110 in order to reduce any component of momentum as it proposed in the example of FIG. 2, and/or actively clamping sheets 110 in order to quash any component of momentum as it proposed in the example of FIG. 3, may allow such an arrangement may be avoided and a horizontal tray may be employed.

Figure 4:
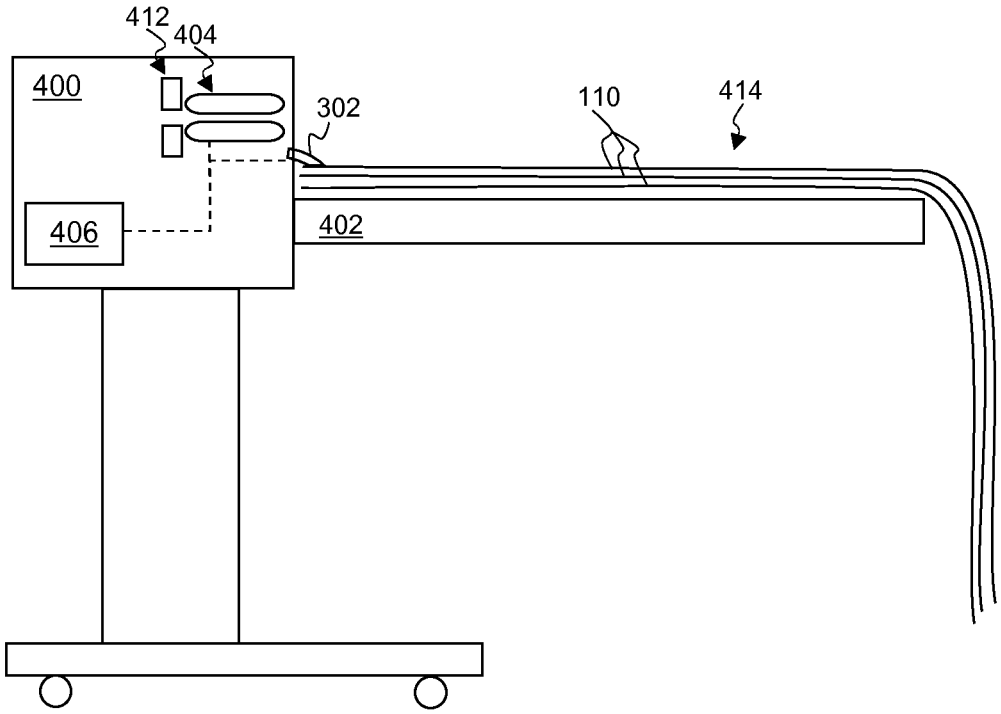

FIG. 4 shows another example of a media stacker 400. In this example, the media stacker 400 comprises a trolley mounted stacker 400, which may be suitable to be rolled up to a printer for use therewith. Such a media stacker 400 may be referred to as a 'printer accessory' or 'printer finisher' or the like.

The media stacker 400 of FIG. 4 comprises a stacking platform 402, a feed mechanism 404, a controller 406, a securing element 302 and a trailing edge detector 412. In this example, the feed mechanism 404 comprise a conveying element having the form of a pair of endless belts. The media stacker 400 is intended to receive at least one print media sheet 110 which is longer than the stacking platform 402. Therefore, in this example, the feed mechanism 404 conveys at least one media sheet 110 having a first length and the stacking platform 402 has a second length, the first length exceeding the second length. As such, at least one of the printed media sheet(s) 110 received thereby at least partially hangs off the end of the platform 402. Such a scenario may be encountered for example when printing relatively large items, for example blue prints, banners, posters and the like. While a larger stacking platform 402 could be provided, or an extension added to the stacking platform 402, this would lead to the assembled printer apparatus taking up additional floor space. The media sheets 110 may form a stack 414 on the platform 402.

When a printed media sheet 110 hangs from the end of the stacking platform 402, the hanging portion exerts a force, urging the printed media sheet 110 to fall from the platform 402, or shift along the platform 402 (potentially creating an edge against which subsequent sheets 110 may catch). In some examples, this force may be countered with friction between media sheets 110, or between the lowermost sheet 110 and the upper surface of the platform 402.

The speed at which a media sheet 110 is conveyed may be determined by the controller 406 such that the momentum with which the media sheet 110 is travelling when it is dispensed is overcome by the friction between a media sheet 110 and the stacking platform 402 for the lowermost sheet 110, or by the friction between media sheets 110 for subsequent sheets. Such friction may be sufficient to hold media sheet(s) 110 on a stacking platform 402, and may determine the ultimate overhanging length of media sheet 110 which will be securely held on the platform 402.

A distinction may be made between 'dynamic' or 'kinetic' friction and 'static' friction. For an object in motion, the friction to be overcome to keep that object moving is generally less than the friction to be overcome to start the object moving. To express this another way, the 'dynamic' friction experienced by an object is generally less than the 'static' friction. As a sheet 110 is released, it has a component of horizontal momentum imparted by the feed mechanism 404, which is to be overcome to ensure that the sheet 110 comes to a rest in the intended location on the platform 402 rather than falling to the floor. In other words, in the present example, a sheet of media 110 is more likely to fall off, or move down, the platform 402 as it is passed thereto than once it is at rest.

The ratio of the maximum length of hanging sheet media material and the length of platform 402 to support and retain the media sheet 110 is affected by various factors, including the speed with which the media sheet 110 is conveyed at the point it is released by a feed mechanism 404 (and therefore the horizontal momentum), the friction between the sheets 110, the weight of material overhanging the platform 402 and the like. Reducing the speed at the point at which the media sheet 110 is released may allow ratios of greater than 1 (i.e. the first length, the length of the media sheet 110, may be at least double the second length, the length of the platform 402).

In some examples, the second speed may be determined bearing this ratio in mind. For example the second speed may be no slower (or not significantly slower) than is appropriate to retain a particular length of media sheet 110 on a particular length of stacking platform 402. For example using a particular paper sheet media and a 980 mm platform, it has been determined that the following ratios of hanging length to platform length may be seen without the paper sheets falling to the ground:

| Speed | (Hanging length)/(Platform length) |
|---|---|
| 15ips | 0.43 |
| 6ips | 0.63 |
| 4ips | 0.83 |

Thus it can be seen that, as speed decreases, the ratio increases and longer media sheets 110 may be held on a platform 402. In the example above, the length of media sheets conveyed was 1400 mm at 15 ips, 1600 mm at 6 ips and 1800 mm at 4 ips. It will be appreciated that these figures relate to a particular combination of apparatus, media and print speeds, and that values may vary depending on these and other factors. By decreasing the speed still further, ratios of greater than 1 may be achieved.

In this example, the controller 406 is further arranged to communicate with a printer associated with the stacker 200. For example, the controller 406 is to communicate a rate at which media sheets 110 may be received thereby, bearing in mind the time taken to dispense a media sheet 110. This information may for example be sent with, or in the same manner as, other control information (for example, indicating that the stacker 200 is powered, correctly coupled, and/or available for use by the printer, or indicating a status such as a fault status, or the like). The determination of the rate is described in greater detail in relation to FIG. 6 below.

In the example of FIG. 4, a securing element 302 is provided. The securing element 302 may have any of the features discussed in relation to the securing element of FIG. 3, and has a securing position, as shown in FIG. 4, in which it acts to secure at least one sheet of media 110 on the stacking platform 402 and a retracted position (shown in dotted line FIG. 5). The controller 406 controls the position of the securing element 302 such that, responsive to a determination that a sheet of media 110 has been, or is imminently to be, dispensed, the controller 406 controls the securing element 302 to move from the securing position to the retracted position, and subsequently from the retracted position to the securing position, thereby securing the dispensed sheet of media 110.

Clamping a sheet 110 in place in order to quash any horizontal component of its velocity means the sheet 110 will be static when the stack is released to accept the new sheet 110. Thus the ratio of the maximum length of hanging sheet media material and the length of platform to support and retain the media sheet may be greater than if the securing element 302 acted after the sheet was at rest.

In the example of FIG. 4, the detection of the trailing edge, and therefore the timing of the deceleration of the feed mechanism 404 and the activation of the securing element 302 is determined using a detector 412, in this example comprising an optical sensor comprising an optical source and a photodetector. Alternative edge detectors may be used in other examples. The presence of a sheet 110 interrupts a beam between the source and the photodetector. As the trailing edge of a sheet 110 passes, the signal at the photodetector increases and the edge is thereby detected. The feed mechanism 404 may be decelerated immediately thereafter or following a determined delay for example based on the spacing between the trailing edge detector 412 and the feed mechanism 404.

The securing element 302 may be activated such that it moves into retracted position, and then back into the securing position after a predetermined time delay which is indicative of the time taken for the trailing edge to pass though the feed mechanism 404 and reach a position at which it can be secured. In some examples, the delay(s) may be determined such that the securing element 302 acts to secure the sheet 110 almost instantaneously on arrival on the platform 402, thus arresting its remaining momentum along the platform 402 due to the speed of the sheet 110 as imparted by the feed mechanism 404 (in some examples, the securing element 302 may drive the trailing edge towards the platform 102). In some examples the time for which the stack 414 is unclamped, i.e. the time for which the securing element 302 is not in the securing positon is minimised. However, it will also be appreciated that, while the securing element 302 is in the retracted position, it is the relatively greater static, rather than dynamic, friction which applies throughout the majority of the stack 414.

Figure 5:
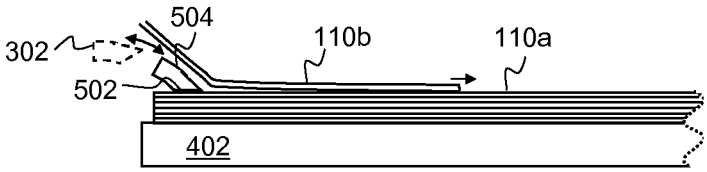
FIG. 5 is a simplified schematic of a portion of an example media stacker.

FIG. 5 shows an example of a securing element 302 in greater detail. When the securing element 302 is in the securing position (shown in solid line), it acts to guide a media sheet 110 onto the top of the stack of sheets 110 while securing the location of sheets 110 lower in the stack relative to the stacking platform 402. In particular, the securing element 302 comprises a first surface 502 to contact a sheet of media 110*a* on the stacking platform 402 and a second surface 504 to guide the leading edge of a subsequent sheet of media 110*b* to overlie a secured sheet of media 110*a* on the stacking platform 402. In some examples, one or a plurality of securing element(s) 302 may contact the sheet 110 at a plurality of locations distributed along the width of the sheet 110. In some examples, a linear array of securing elements 302 is provided.

In some examples, the securing element 302 presses down on the sheets 110 to secure them, for example under the action of a biasing element (which may be a resilient element such as a spring), a servo, a stepper motor or the like. In this example, based on the time at which the trailing edge of a sheet 110 is detected (for example, determined as an offset from the trailing edge being detected by the detector 412, wherein the offset is determined to coincide with the trailing edge of the sheet 110 moving through or exiting a feed mechanism 104), the securing element 302 is moved, under the control of the controller 406, into the retracted position shown in dotted lines. This allows the trailing edge to fall onto the top the stack in an aligned manner with the stack 414 therebelow. In addition, it means that the trailing edge will be in a position to be secured by the securing element 302 as it moves back into the securing position. In some examples, the securing element 302 may remain in the retracted position until the leading edge of a subsequent sheet 110 is detected, or is imminently expected to be dispensed onto the platform 402. In this example, however, the controller 108 is to control the securing element 302 such that there is a predetermined time spent in the retracted position. This time may be relatively brief, for example being determined as the time for the trailing edge of the sheet 110 to settle below a level at which it will be acted on by the securing element 302 (which may or may not mean that the sheet 110 is fully settled on the stack/platform 402). In some examples, the time spent in the retracted position may be less than 1 second, or less than 0.5 seconds, or less than 0.1 seconds. In one example, the time spent in the retracted position is on the order of 0.05 seconds.

In some examples, for example where the trailing edge of a sheet 110 is detected by a detector 412, the same detector signal which triggers a deceleration of the feed mechanism 104 may be used, for example with a delay, to trigger the securing element 302 such that it moves into the securing position after a predetermined time delay which is indicative of the time taken for the trailing edge to pass though the feed mechanism 404 and reach a position at which it can be secured. In some examples, the delay may be determined such that the securing element 302 acts to secure the sheet 110 almost instantaneously on arrival on the platform 402, thus arresting its remaining momentum along the platform 402 due to the speed of the sheet 110 as imparted by the feed mechanism 404.

Figure 6:
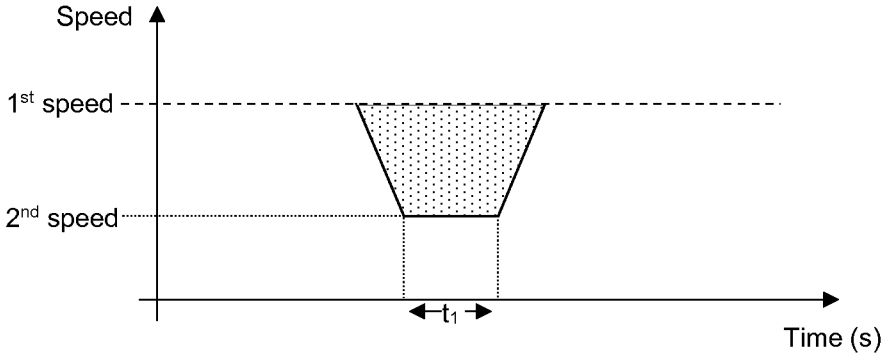
FIG. 6 is a graph relating to the speed of conveying sheet media in an example.

FIG. 6 shows a graph to illustrate a rate at which media sheets may be supplied, for example from a printer, to a stacker 100, 300, 400. The stacker 100, 300, 400 in this example is operated such that the first speed is the speed of the printer. In this example, the printer speed is not altered (although this could be the case in other examples). Instead, the controller 108, 406 creates an instruction to the printer requesting a spacing between the sheets. This spacing is determined to be the difference between the time to convey the second sheet at the higher speed (in this example, the printer speed), and the time to process a portion of the sheet at the higher speed, decelerate for a trailing portion convey the trailing portion and then, after the sheet has been dispensed, accelerate a feed mechanism back to the first speed. In this example, the second, lower, speed may be 2 ips, and the time $t_1$ spent at this speed may be 0.5 seconds, such that the trailing 1 inch of the sheet is conveyed at the lower speed before being dispensed onto the platform 102, 402. Such a change to printer operation is relatively straightforward to communicate to the printer and does not unduly slow print operations. For example, there is no need to adapt print modes or printer media advance, since the media sheet is slowed after it has left the printer. For example a stacker 100, 200, 300, 400 may generally request sheets separated by around 50 mm, but if operating according to the principles set out herein, this may be increased to, for example, between around 135 and 275 mm.

Figure 7:
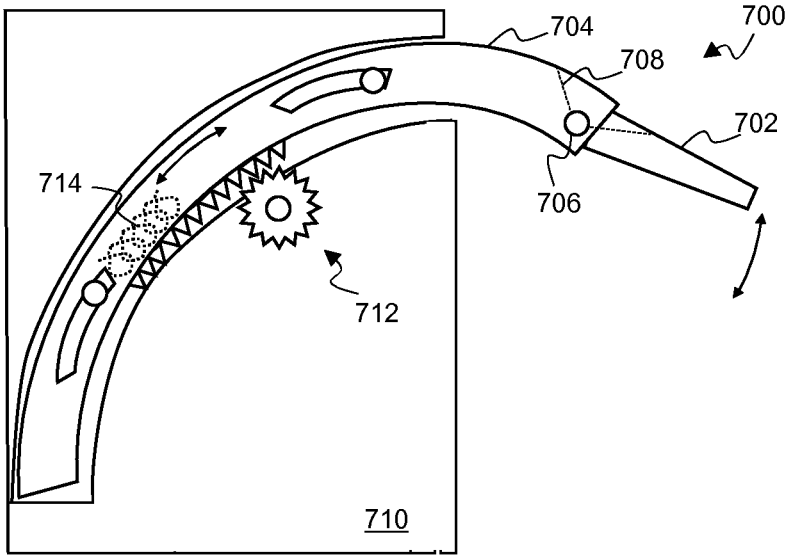
FIG. 7 is a simplified schematic of an example of a securing element.

FIG. 7 is another example of a securing element 700. In this example, the securing element 700 comprises a first portion 702 and a second portion 704, which are mounted with a pivot point 706 therebetween. A biasing means, in this example, a torsion spring 708, acts to allow the portions 702, 704 to rotate about the pivot point 706. The arrangement of FIG. 7 shows the relative positon of the portions 702, 704 at rest. The torsion spring 708 allows the first portion 702 to deflect downwards under the weight of media above the securing element 700, so as to avoid lifting the media, for example if the securing element 700 is retracted while media is being dispensed above the securing element 700.

The securing element 700 is housed in a housing 710. The location of the securing element 700 within the housing 710 is, in this example, controlled using a 'rack and pinion' arrangement 712, where the pinion may be driven by a servo or other motor (not shown) under the control of a controller 108, 406. Other control apparatus may be used to position the securing element 700 in other examples. The securing element 700 is, in this example, drawn back into the retracted positon by the rack and pinion arrangement 712 against the action of an extension spring 714. The pinion is then released (for example under the control of a controller 108, 406), allowing the securing element 700 to assume a securing position under the action of the spring 714.

The spring 714 urges the first portion 702 downwards towards a stack secured thereby. As the securing element 700 is urged onto the stack under the action of the spring 714, the securing element 700 may automatically adapt its securing position for a growing stack without a need to move the platform 102, 402. Moreover, it may be noted that the force is controlled by the spring 714 and not a motor or the like used to position the securing element 700. As such, the securing force may be reliable controlled, limiting any risk of damage to the media (or the printed surface thereof) should the motor be driven too far.

In some examples, a linear array of securing elements 302, 700 is provided, which are intended to be distributed along the length of a trailing edge of a sheet media. In such examples, use of such a resilient securing element 700 may allow media with different widths to be stacked, where the securing elements 700 of the array adapt to an uneven stack, providing a predetermined clamping force which is substantially constant over the width of the stack.

In some examples, a securing element 302, 700 may comprise at least a first and second section which have a telescoping arrangement such that, when the securing element 302, 700 is in the securing position, the second section extends beyond the first section. However, when in the retracted position, the length of the second section substantially overlaps with the length of the first section. In other words, the securing element 302,700 may have an extended configuration, which it adopts when in the securing position, and a retracted configuration, which it adopts when in the retracted position.

Figure 8:
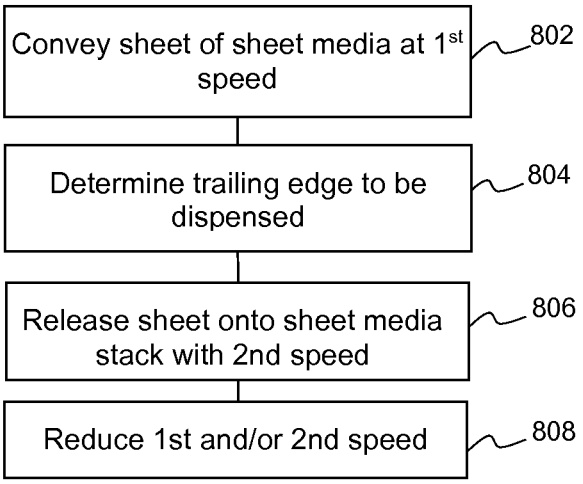
FIGS. 8 to 11 are flowcharts of example methods of conveying media sheets.

FIG. 8 is a flowchart setting out an example of a method. In block 802, at least a portion of a sheet of sheet media is conveyed with a first speed. A determination that a trailing edge of the sheet of sheet media is to be dispensed onto a stacking platform is made in block 804. In block 806, the sheet of sheet media is released onto the stacking platform with a second speed. In block 808, at least one of the first and the second speed is reduced in response to the determination that a trailing edge of the sheet of sheet media is to be dispensed onto a stacking platform. In some examples, the first and the second speed are different. In other examples, the first and the second speed are the same.

Figure 9:
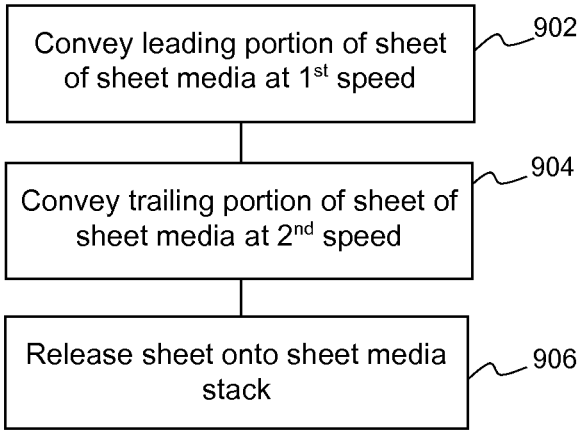

FIG. 9 is a flowchart setting out another example of a method. In this example the speed of a sheet is reduced before the trailing edge of the sheet is dispensed such that the second speed is lower than the first speed. In particular, in block 902, a leading portion of a sheet of sheet media is conveyed at a first speed. In block 904, a trailing portion of the sheet of sheet media is conveyed at a second speed. The second speed may for example be determined such that the momentum of the sheet when released by the feed mechanism is overcome by friction between the sheet and a sheet media stack, or may be predetermined. A sheet media stack may comprise at least one sheet of sheet media. In block 906, the sheet of sheet media is released onto the sheet media stack arranged on a stacking platform. The method may be carried out repeatedly.

Figure 10:
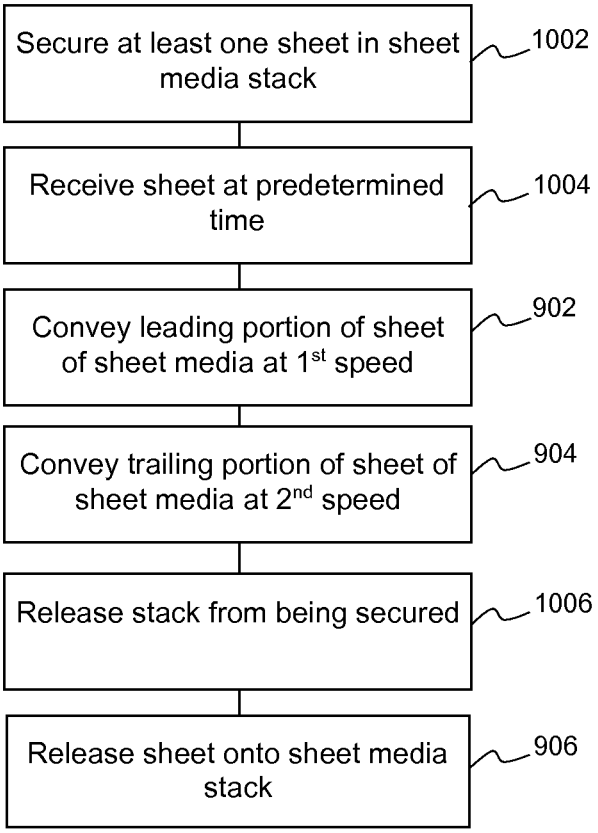

FIG. 10 shows another example of a method, in this example comprising a method of conveying and dispensing a plurality of sheets of sheet media. In block 1002, at least one sheet (and in some examples, a sheet media stack) is secured (for example by a securing element 302, 700). In block 1004, a sheet of sheet media is received at a predetermined time. In this example, the time is determined according to the time to convey a sheet of sheet media and a time to accelerate to the first speed after conveying the trailing portion of a sheet of sheet material at the second speed. The method then continues with blocks 902 and 904 as set out in FIG. 9. Prior to (in some examples, immediately prior to) the release of the sheet, the stack is released from being secured (block 1006). The sheet is then released onto the stack (block 906), and the method may return to block 1002. In some examples, the sheet may be released before (in some examples immediately before) the stack is released. In some examples, the stack, now including the newly released sheet, is secured substantially instantaneously with the sheet reaching the stack. In some examples, the sheet may be driven towards the stack by a securing element acting to secure the stack.

In some examples, the method of FIG. 9 or FIG. 10 may be carried out by a stacker 100, 200, 400 for example as described above, and a stack of media sheets may be formed on a platform 102, 402. In examples in which a stack of media sheets is formed on a platform 102, 402 which is shorter than the length of at least one sheet, the second speed may be determined such that the momentum of the sheet when released and a force due to weight of a sheet portion overhanging the platform are overcome by friction between the sheet and the sheet media stack. In some examples, a length of the leading portion is substantially greater than a length of the trailing portion. For example, the length of the leading portion may be at least 10 times the trailing portion, or may comprise at least on the order of 90%, 95%, 98% or 99% of the length of the sheet.

Figure 11:
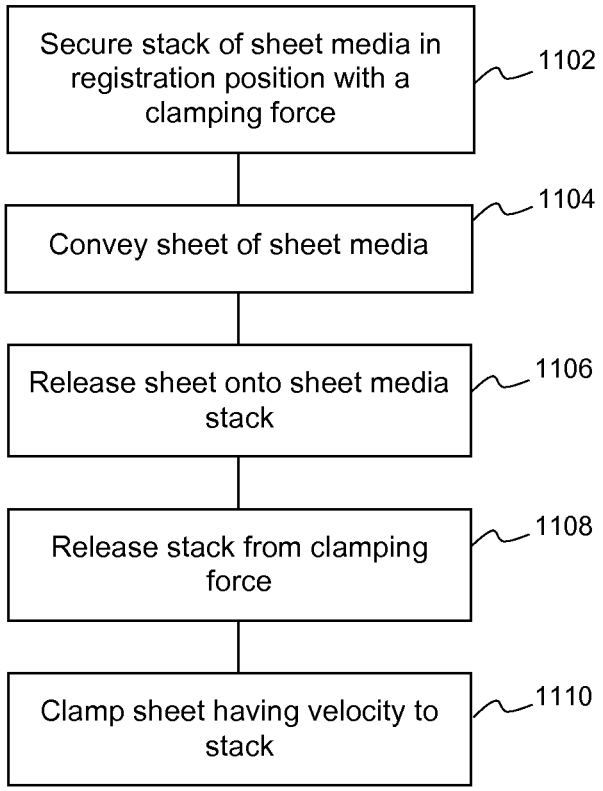

FIG. 11 is a flowchart setting out an example of a method. In block 1102, a stack of sheet media is secured in a registration position with a clamping force. In block 1104, a sheet of sheet media is conveyed with a velocity, and in block 1106, the sheet is released onto the stack. In block 1108, the stack is released from the clamping force and in block 1110, the sheet, while having a lateral component of velocity parallel to the surface of the stack, is secured to the stack by reapplying the clamping force, such that the clamping force arrests the sheet. The stack may comprise at least one media sheet. The method may be carried out repeatedly.

In some examples, the method of FIG. 11 may be carried out by a stacker 100, 300, 400, for example as described above, and the stack of media sheets may be formed on a platform 102, 402. In some examples, the speed with which a sheet is conveyed and the speed with which it is dispensed (the first and second speeds of the method of FIG. 8) may be the same.

In some examples, the sheet may be released onto the stack in block 1106 before (in some examples immediately before) the stack is released in block 1108. In other examples, the sheet may be released onto the stack in block 1106 after (in some examples immediately after) or as the stack is released in block 1108. In some examples, a stack including the newly released sheet, is re-secured substantially instantaneously with the sheet (or trailing edge thereof) reaching the stack. In some examples, the time between releasing the stack and reapplying the clamping force is less than 0.5 seconds, or on the order of, or less than, 0.1 second. In some examples, the time is determined according to the speed of the media at the point it is released and the reach of the securing element 302, 700. For example, the securing element 302, 700 may be controlled to move quickly enough to 'catch' the sheet. In some examples, the securing element may act in around 200 ms in order to catch a media sheet before the sheet can move beyond a securing element's reach (which may in some examples be around 3 inches).

In some examples, a sheet media stack is formed on a platform which is shorter than the length of at least one sheet, and the clamping secures the sheet against a force of the weight of a sheet portion overhanging the platform. In some examples, the clamping force is applied in a direction which is substantially perpendicular to the surface of the stack. This reduces the risk of marking the sheet (or the printed surface thereof) as there may be reduced relative lateral movement. In addition, it may be easier to control the clamping force it is applied substantially perpendicularly.

In some examples, the methods of any of FIGS. 8 to 11 are for use with a stacker 100, 200, 300, 400 which may be associated with a high speed printer (for example a printer which operates at around or above 15 ips), a printer having a continuous print mode; and/or a printer which prints 'long plots', i.e. sheets which are relatively long (around 1-2 m or longer).

Figure 12:
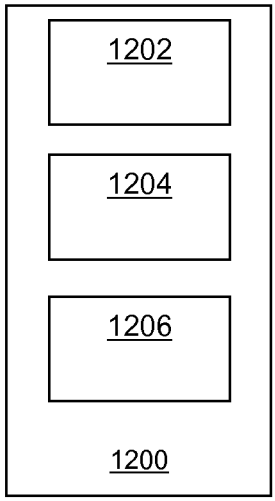
FIG. 12 is a simplified schematic of an example of a printer.

FIG. 12 is a schematic example of a printer 1200 comprising a media stacker 1202, a speed control module 1204 and a sheet separation module 1206. In some examples, the media stacker 1202 may comprise a stacker as described in relation to any of FIGS. 1-4. The speed control module 1204 is to control a speed at which successive sheets of print media are conveyed through the media stacker, wherein a first (leading) portion of the length of each sheet is conveyed at a first speed, and a trailing portion of each sheet is conveyed at a second speed which is lower than the first speed. The speed control module 1204 may determine at least one of the first speed, the second speed, the length of the first portion and the length of the trailing portion, for example based on any of user input, data characterising the length of a media sheet, data characterising the length of a platform, data characterising the level of friction provided by a media sheet, or the like. In other examples, at least one of the first speed, the second speed, the length of the first portion, and the length of the trailing portion may be predetermined.

The sheet separation module 1206 is to control the printer to provide printed sheets of print media to the media stacker 1202 with a separation based on the difference between a determined time to convey the trailing portion of sheet at the first speed (i.e. the time which would be taken were the trailing portion to have been conveyed at the first speed) and the time taken by the media stacker 1202 to convey the second portion of the sheet at the second speed. In some examples, the separation may further be based on a time to increase the speed of a print media feed mechanism from the second speed to the first speed. For example, this separation may be determined according to the principles described in relation to FIG. 6 above. In some examples, the separation may result in a sheet separation based on the difference between the time to convey a sheet in its entirety at the first speed, and the total of (i) the time to convey the sheet with the lower second speed for a portion thereof (which may include a deceleration time) and (ii) the time to accelerate a feed mechanism of the media stacker 1202 to the first speed.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors. The controllers 108, 406 and/or modules 1204, 1206 described above may each comprise at least one processor.

Such machine readable instructions may also be stored in a computer readable storage that can guide the computer or other programmable data processing devices to operate in a specific mode.

Such machine readable instructions may also be loaded onto a computer or other programmable data processing devices (which may for example comprise a controller 108, 406 or module 1204, 1206 as described above), so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example. In particular, the features of any one of the stackers 100, 200, 300, 400 of FIGS. 1 to 4 may be combined in any combination with the features of any other one of the stackers 100, 200, 300, 400 of FIGS. 1 to 4. The controllers 108, 406 of any of FIGS. 1 to 4 may have any of the features of another of the controllers 108, 406.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A media stacker comprising:

a stacking platform having a length and a distal edge from which to hang a portion of a printed media sheet that is disposed on the platform and has a length greater than the length of the stacking platform;

a feed mechanism to convey media sheets longer than the stacking platform for dispensing onto the stacking platform, wherein the media sheets are dispensed onto the stacking platform with a momentum imparted by the feed mechanism such that a portion of each media sheet rests on the stacking platform while a further portion of each media sheet extends beyond, and hangs from the edge of, the stacking platform;

a media arresting mechanism to reduce the momentum of media sheets;

a controller to operate the feed mechanism and media arresting mechanism to dispense a first major portion of a sheet to the stacking platform at a first speed and then a second, subsequent minor portion of the sheet at a second, lower speed by controlling the media arresting apparatus to reduce the momentum of the media sheet when dispensing the second minor portion to the stacking platform, the controller designating a portion of the sheet between the first major portion and the second minor portion as a deceleration portion for transition from the first speed to the second speed; and a securing element moveable by the controller to apply pressure to fully arrest movement of a sheet when that sheet has been dispensed to the stacking platform;

the controller to operate the feed mechanism and securing element together to prevent a sheet from falling off the distal edge of the stacking platform.

2. A media stacker according to claim 1 wherein the controller is to control the feed mechanism to adjust a speed with which a media sheet is conveyed including an error margin with respect to length of the sheet when dispensing the second minor portion and trailing edge of the media sheet onto the stacking platform.

3. A media stacker according to claim 1 in which the controller is to determine when to reduce to the second, lower speed a speed at which the sheet is dispensed to the stacking platform using a timer and based on a time to dispense a media sheet which is conveyed by the feed mechanism.

4. A media stacker according to claim 1 comprising a trailing edge detector to detect the trailing edge of the media sheet.

5. A media stacker according to claim 1 wherein the securing element is moveable between a securing position, in which it acts to secure at least one media sheet on the stacking platform, and a retracted position; and the controller is to control the position of the securing element responsive to a determination that a media sheet is to be dispensed, wherein the controller controls the securing element to secure a media sheet.

6. A media stacker according to claim 5 in which the controller is to control the securing element responsive to a determination that a media sheet is to be dispensed to move from the securing position to the retracted position, and subsequently from the retracted position to the securing position, thereby securing the dispensed media sheet.

7. A media stacker according to claim 5 wherein the controller is to control the securing element such that there is a predetermined time spent in the retracted position.

8. A media stacker according to claim 5 wherein the securing element comprises a first surface to contact a media sheet on the stacking platform and a second surface to guide the leading edge of a subsequent media sheet to overlie a secured media sheet on the stacking platform.

9. A media stacker according to claim 1 wherein the controller is to determine when to reduce to the second, lower speed a speed at which the sheet is dispensed to the stacking platform by counting revolutions of a roller in the feed mechanism.

10. A media stacker according to claim 1 wherein the second speed is a minimum speed of the feed mechanism.

11. A method comprising dispensing a sheet of sheet media to a stacking platform such that the sheet, which is longer than the stacking platform, is partially disposed on the stacking platform, but extends beyond and hangs down from a distal edge of the stacking platform, the dispensing comprising:

conveying at least a portion of the sheet of sheet media with a first speed;

determining that a trailing edge of the sheet of sheet media is to be dispensed onto the stacking platform;

slowing a speed at which a trailing portion of the sheet that precedes the trailing edge is dispensed prior to releasing the sheet of sheet media onto the stacking platform with a second speed;

wherein a leading portion of the sheet from a leading edge to the trailing portion of the sheet is dispensed to the stacking platform at the first speed, which is faster than the second speed;

securing a stack of sheet media on a stacking platform in a registration position with a clamping force;

releasing the sheet having the second speed onto the stack parallel to the surface of the stack; and releasing the stack from the clamping force securing the sheet having a lateral component of velocity parallel to the surface of the stack to the stack by reapplying the clamping force, wherein the clamping force reduces the second speed by arresting the sheet.

12. A method according to claim 11 in which the trailing portion comprises at least an inch of length of the sheet of sheet media.

13. A method according to claim 11 in which the leading portion is a majority of the sheet that is dispensed to the stacking platform at the first speed before conveying of the sheet is reduced to the second, slower speed in response to determining that the trailing portion of the sheet is to be dispensed onto the stacking platform.

14. A printer comprising:

a continuous print mode print engine to print large-scale media sheets of a meter or more in length;

a media stacker to receive and stack the large-scale sheets from the print engine;

a stacking platform of the media stacker, the stacking platform having a length and a distal edge from which to hang a portion of a printed large-scale sheet that is disposed on the platform and has a length greater than the length of the stacking platform;

a feed mechanism to convey the large-scale sheets that are longer than the stacking platform for dispensing onto the stacking platform, wherein the large-scale sheets are dispensed onto the stacking platform with a momentum imparted by the feed mechanism such that a portion of each sheet rests on the stacking platform while a further portion of each sheet extends beyond, and hangs from the edge of, the stacking platform;

a controller to use input from a sensor or a timer to determine when a trailing portion of each sheet is yet to be released to the stacking platform, the trailing portion comprising a predetermined amount of a sheet before a trailing edge of the sheet;

the controller to control a speed control module to control a speed at which successive sheets are conveyed to the stacking platform, wherein a first portion of a length of each sheet is conveyed at a first speed to the stacking platform, and the trailing portion of each sheet is conveyed to the stacking platform at a second speed which is lower than the first speed; and a securing element moveable by the controller to apply pressure to fully arrest movement of a sheet when that sheet has been dispensed to the stacking platform;

the controller to operate the speed control module and securing element together to prevent a sheet from falling off the distal edge of the stacking platform.

15. The printer of claim 14 further comprising a sheet separation module, wherein the sheet separation module is to control the printer to provide printed sheets of print media to the media stacker with a separation determined based on the difference between a determined time to convey the trailing portion of a sheet at the first speed, and the time taken by the media stacker to convey the trailing portion of the sheet at the second speed.

16. The printer of claim 14 in which the controller is to determine when a trailing portion of each sheet is to be released to the media stacker using an optical sensor.

17. The printer of claim 14 in which the controller is to determine when a trailing portion of each sheet is to be released to the media stacker using a timer and a value for the first speed.

18. The media stacker according to claim 1 wherein the controller is to control the media arresting apparatus to reduce speed of at least a final inch of the trailing edge of the media sheet as dispensed to the stacking platform.

19. The method according to claim 11, wherein a length of the sheet is at least double a length of the stacking platform.

* * * * *